US009570860B1

(12) United States Patent
Chien

(10) Patent No.: US 9,570,860 B1
(45) Date of Patent: Feb. 14, 2017

(54) ELECTRICAL CONNECTOR PROVIDING SECURED PLUGGING AND CONVENIENT UNPLUGGING

(71) Applicant: KINNEXA, INC., Taipei (TW)

(72) Inventor: Shin-Hao Chien, Taipei (TW)

(73) Assignee: KINNEXA, INC., Taipei (TW)

( * ) Notice: Subject to any disclaimer, the term of this patent is extended or adjusted under 35 U.S.C. 154(b) by 0 days.

(21) Appl. No.: 14/948,389

(22) Filed: Nov. 23, 2015

(51) Int. Cl.
*H01R 13/627* (2006.01)
*H01R 13/6582* (2011.01)

(52) U.S. Cl.
CPC ..... *H01R 13/6582* (2013.01); *H01R 13/6271* (2013.01)

(58) Field of Classification Search
CPC ..... H01R 13/6582; H01R 13/6271
USPC ..... 439/350–357
See application file for complete search history.

(56) References Cited

U.S. PATENT DOCUMENTS 5,660,558 A * 8/1997 Osanai ..... H01R 13/6582 439/353

* cited by examiner

*Primary Examiner* — Javaid Nasri
(74) *Attorney, Agent, or Firm* — Leong C. Lei

(57) ABSTRACT

The connector contains a main member, a casing member housing the main member, and a sliding member slidably configured on the casing member. The main member contains a flexible locking element along a lateral side. The sliding member has a second bulge element along a lateral side's internal wall for engaging the locking element. When a user holds and pulls the sliding member backward, the second bulge element presses the locking element, and the locking element is pushed to escape the detainment by a female connector. The present invention therefore achieves secured and convenient plugging and unplugging.

9 Claims, 7 Drawing Sheets

ELECTRICAL CONNECTOR PROVIDING SECURED PLUGGING AND CONVENIENT UNPLUGGING

BACKGROUND OF THE INVENTION (a) Technical Field of the Invention

The present invention is generally related to an electrical connector, and more particular to an improved electrical connector providing secured plugging and convenient unplugging.

(b) Description of the Prior Art

Electrical connectors are of various specifications and technologies. For example, there are USB connectors, HDMI connectors, etc., to name just a few. Connectors of different specifications are of course structured differently. For the recent Super Mobile High-definition Link (Super MHL) connectors which provides high-definition video images, they are quite inconvenient in terms of plugging and unplugging due to their rather small dimensions.

SUMMARY OF THE INVENTION

The present invention therefore provides a novel connector so as to obviate the shortcomings of the prior art.

A major objective of the present invention then is to provide a connector with secured and convenient plugging and unplugging To achieve the objective, the connector contains a main member containing a terminal assembly where at least a flexible locking element is configured along a lateral side of the terminal assembly. At least a casing member houses the main member. The main member further contains an insulator sleeve for receiving a front portion of the terminal assembly, and a shielding enclosure joining to a back side of the insulator sleeve and enclosing a back portion of the terminal assembly. The shielding enclosure has at least a first bulge element for engaging the second driving element and a drive element connected to the first bulge element for pressing the locking element, both along a lateral side of the shielding enclosure. A sliding member is slidably configured along a circumference of the casing member. A second bulge element is configured along a lateral side's internal wall for engaging the locking element. When a user holds and pulls the sliding member backward, the second bulge element presses the first bulge element, the drive element moves inward, and the locking element is pushed to escape the detainment by the female connector. The connector then can be conveniently detached from the female connector.

The connector of the present invention, as described above, can be applied to carry Super MHL signals and resolve the prior art's inconvenience problems due to the small dimension.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
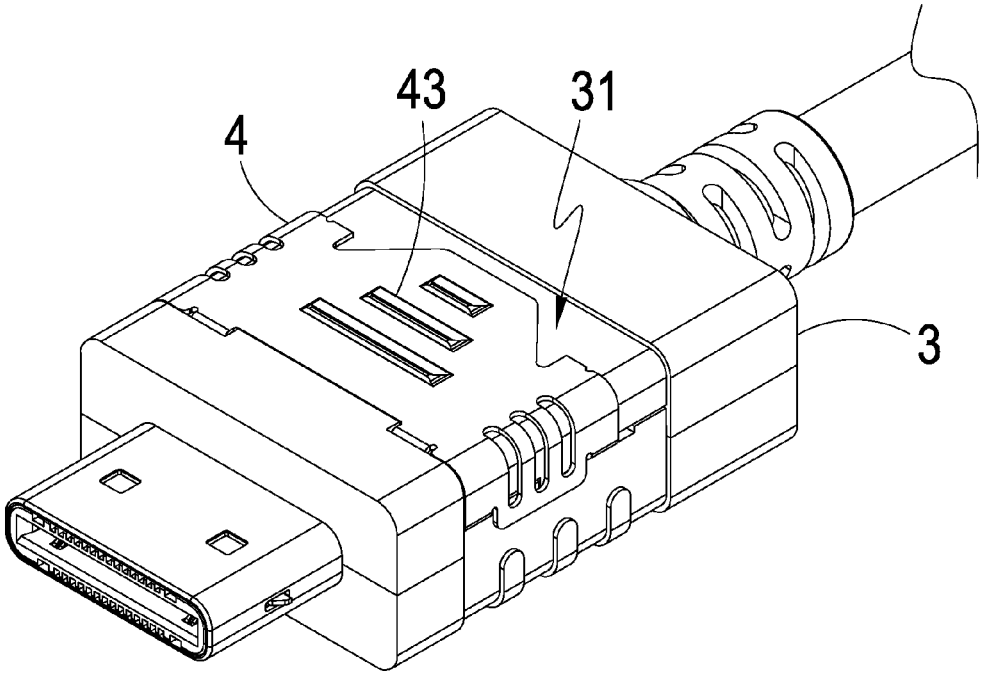
FIG. 1 is a perspective diagram showing a connector according to an embodiment of the present invention.
Figure 2:
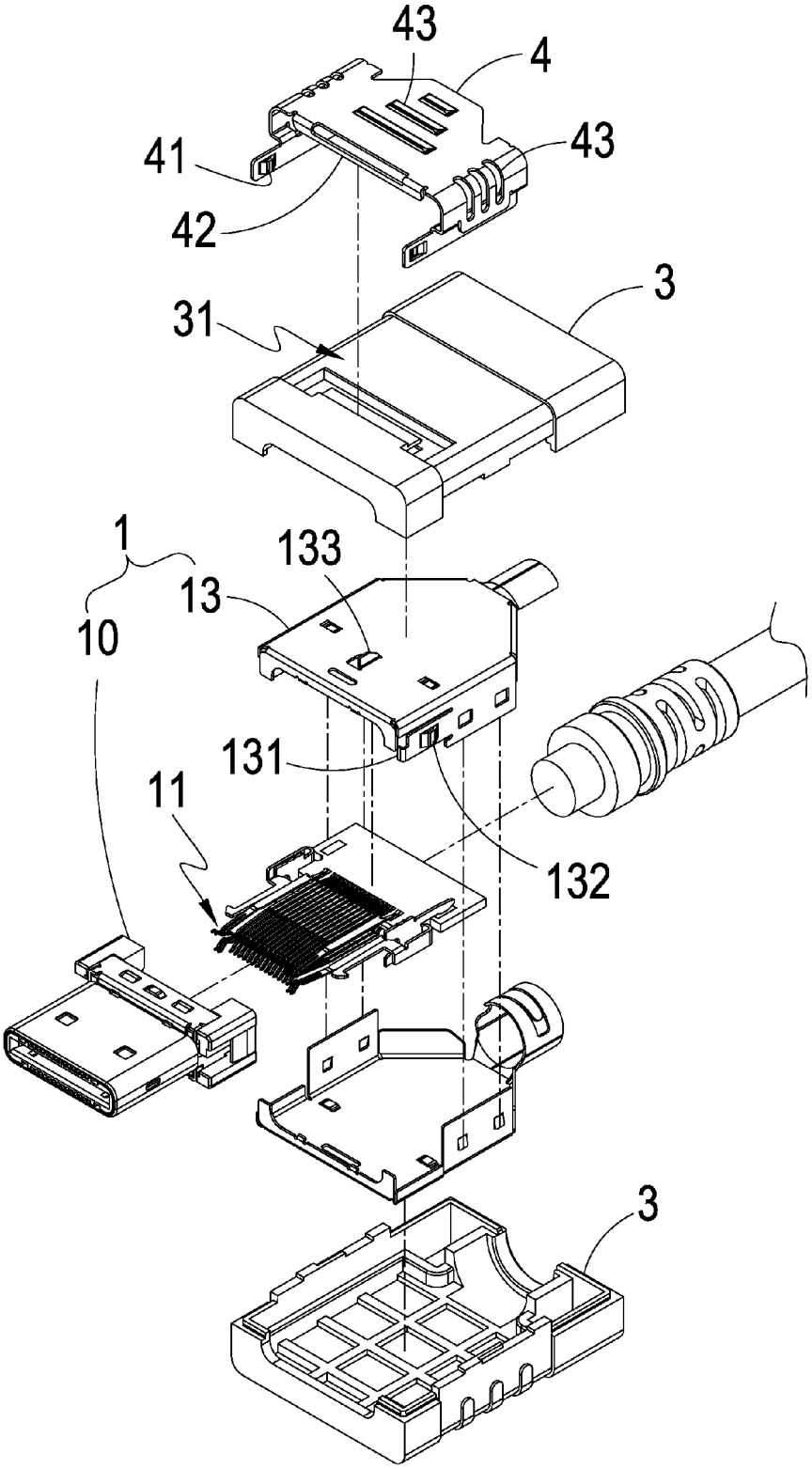
FIG. 2 is a perspective break-down diagram showing the various components of the connector of FIG. 1.
Figure 3:
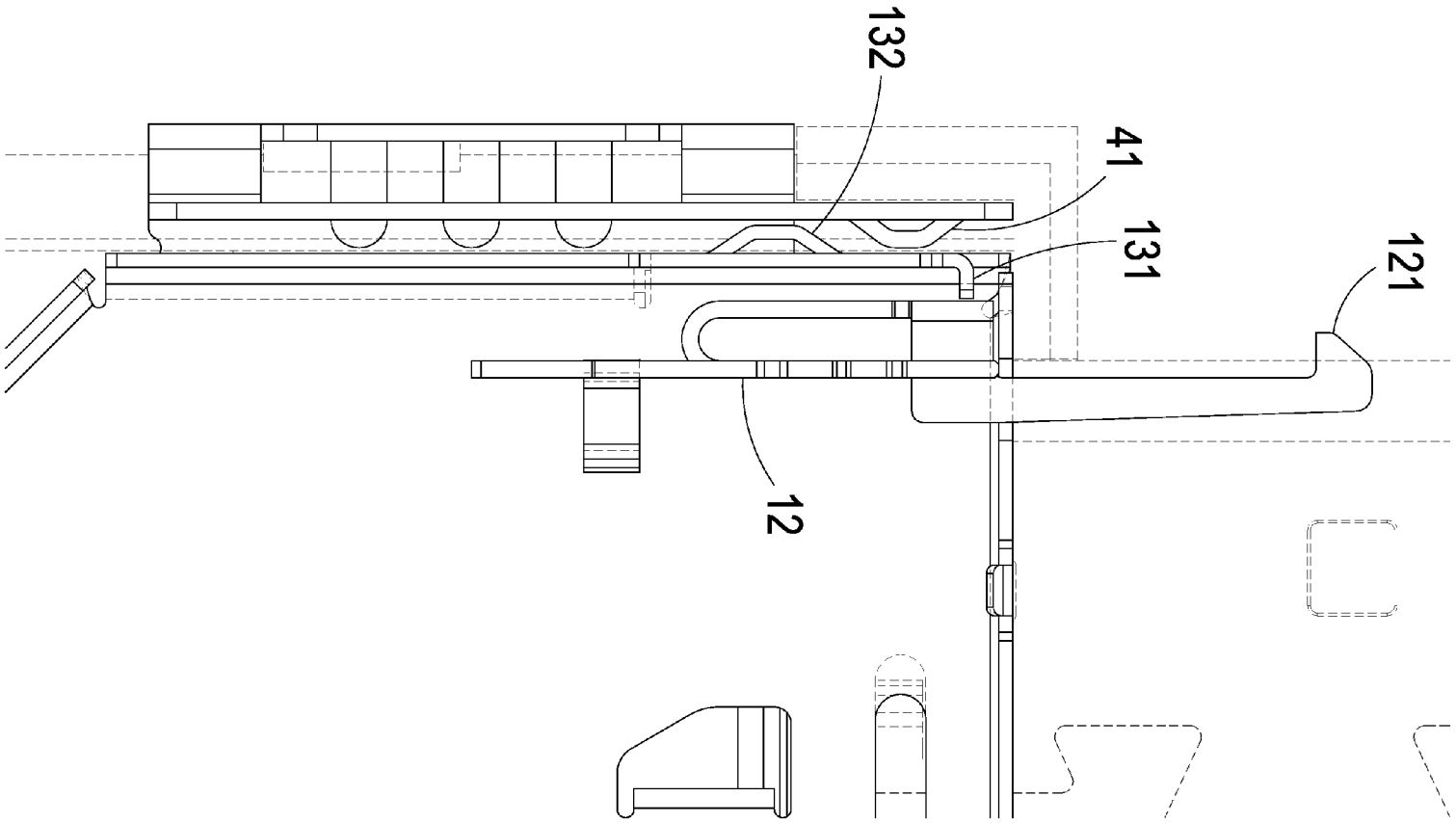
FIG. 3 is a sectional partial diagram showing the connector of FIG. 1.

As shown in FIGS. 1 to 3, a connector according to an embodiment of the present invention is a male connector, and contains the following components.

A main member 1 is provided. The main member 1 contains a terminal assembly 11 conforming the Super Mobile High-definition Link (Super MHL) communication protocol. At least a flexible locking element 12 is configured along a lateral side of the terminal assembly 11. The locking element 12 has a hook 121 at a front end for engaging a female connector. The main member 1 further contains an insulator sleeve 10 for receiving a front portion of the terminal assembly 11, and a shielding enclosure 13 joining to a back side of the insulator sleeve 10 and enclosing a back portion of the terminal assembly 11. The shielding enclosure 13 has at least a first bulge element 132 and a drive element 131 connected to the first bulge element 132, both along a lateral side of the shielding enclosure 13. The drive element 131 is for pressing the locking element 12. There is also at least a limiting element 133 on a major side of the shielding element 13.

A casing member 3 is provided to house the main member 1 and the insulator sleeve 10 protrudes from a front side of the casing member 3. Around a middle section of the casing member 3's circumference, there is an indentation 31 where a sliding member 4 is slidably configured.

The sliding member 4 has an inverted U-like shape. At least a bulge element 41 is configured along a lateral side's internal wall for engaging the bulge element 132. On a top side of the sliding member 4, at least a handle element 43 is configured for the convenience of a user to exert force to slide the sliding member 4. The handle element 43 can be a through slot, a ditch, or a rib. Along a front edge of the sliding member 4, a resilient element 42 is configured to be engaged by the limiting element 133 for restoring the sliding member 4.

Figure 4:
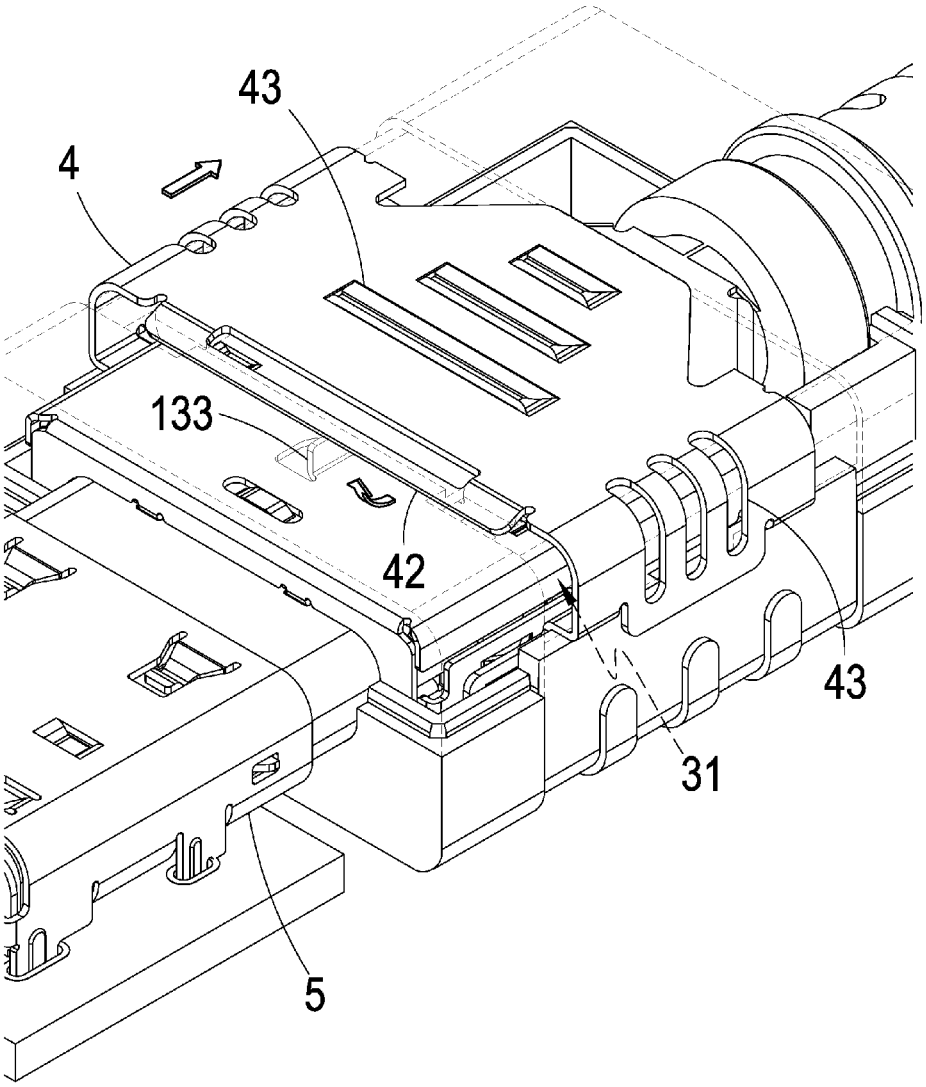
FIG. 4 is a perspective diagram showing the connector of FIG. 1 when it is to be unplugged from a female connector.
Figure 4A:
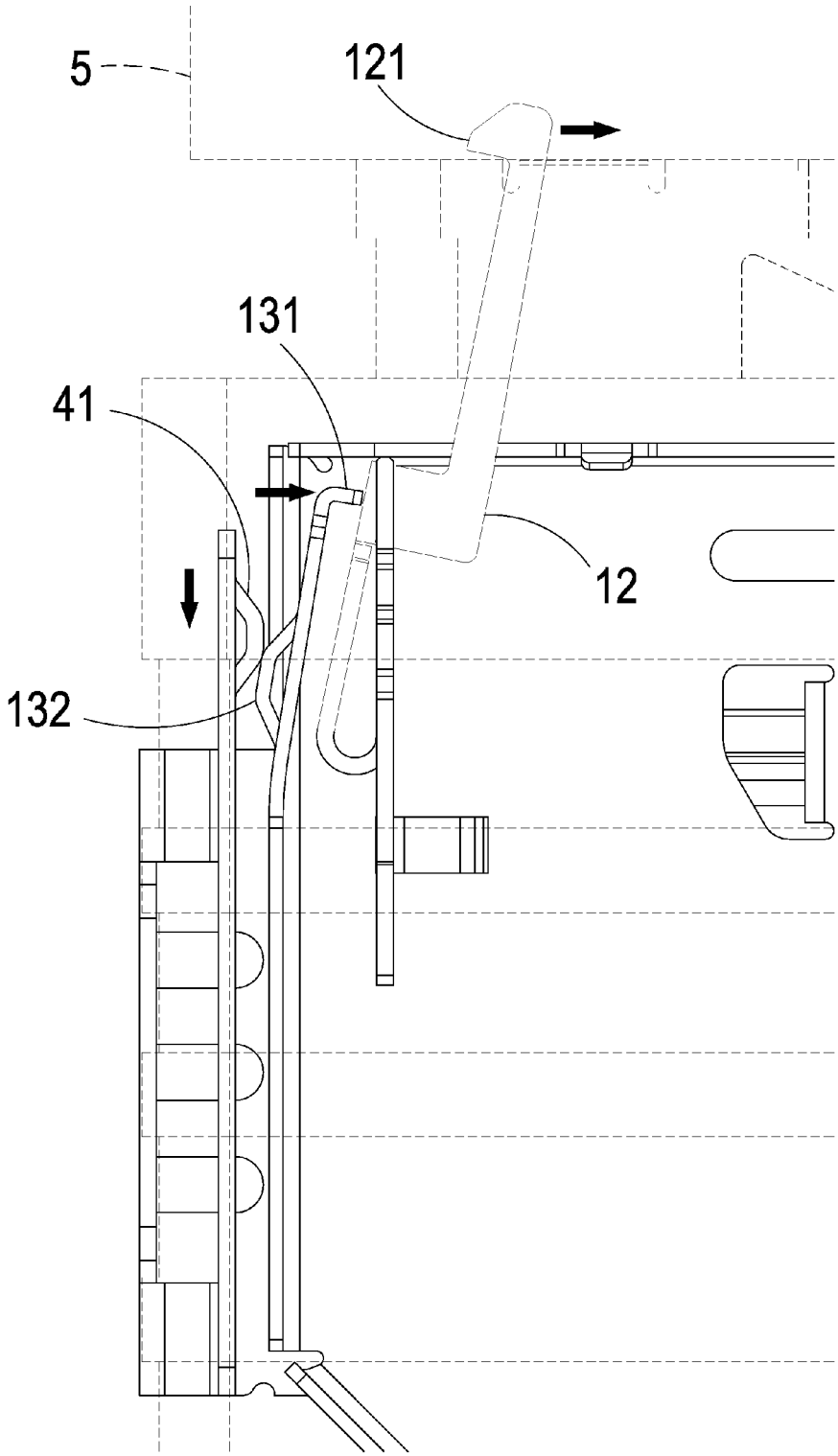
FIG. 4A is a sectional partial diagram showing the connector of FIG. 4.

As shown in FIGS. 4 to 4A, to unplug a connector of the present embodiment from a corresponding female connector 5, the sliding member 4 is pulled backward within the indentation 31 by a user's exerting force on the handle element 43. As the sliding member 4 moves backward, the bulge element 41 contacts and presses the bulge element 132. The drive element 131, as it is connected to the bulge element 132, moves inward to press the flexible locking element 12 as well. The hook 121 at the front end of the locking element 12 as such escapes the female connector 5's detainment. The user then can remove the connector of the present embodiment away from the female connector 5. During the process that the sliding member 4 is pulled backward, the limiting element 133 forces the resilient element 42 to flip and restoration energy is stored the resilient element 42. Once the connector is detached from the female connector 5 and the force on the sliding member 4 is removed, the resilient element 42 releases the stored energy and restores the sliding member 4 to its original location in the indentation 31.

Figure 5:
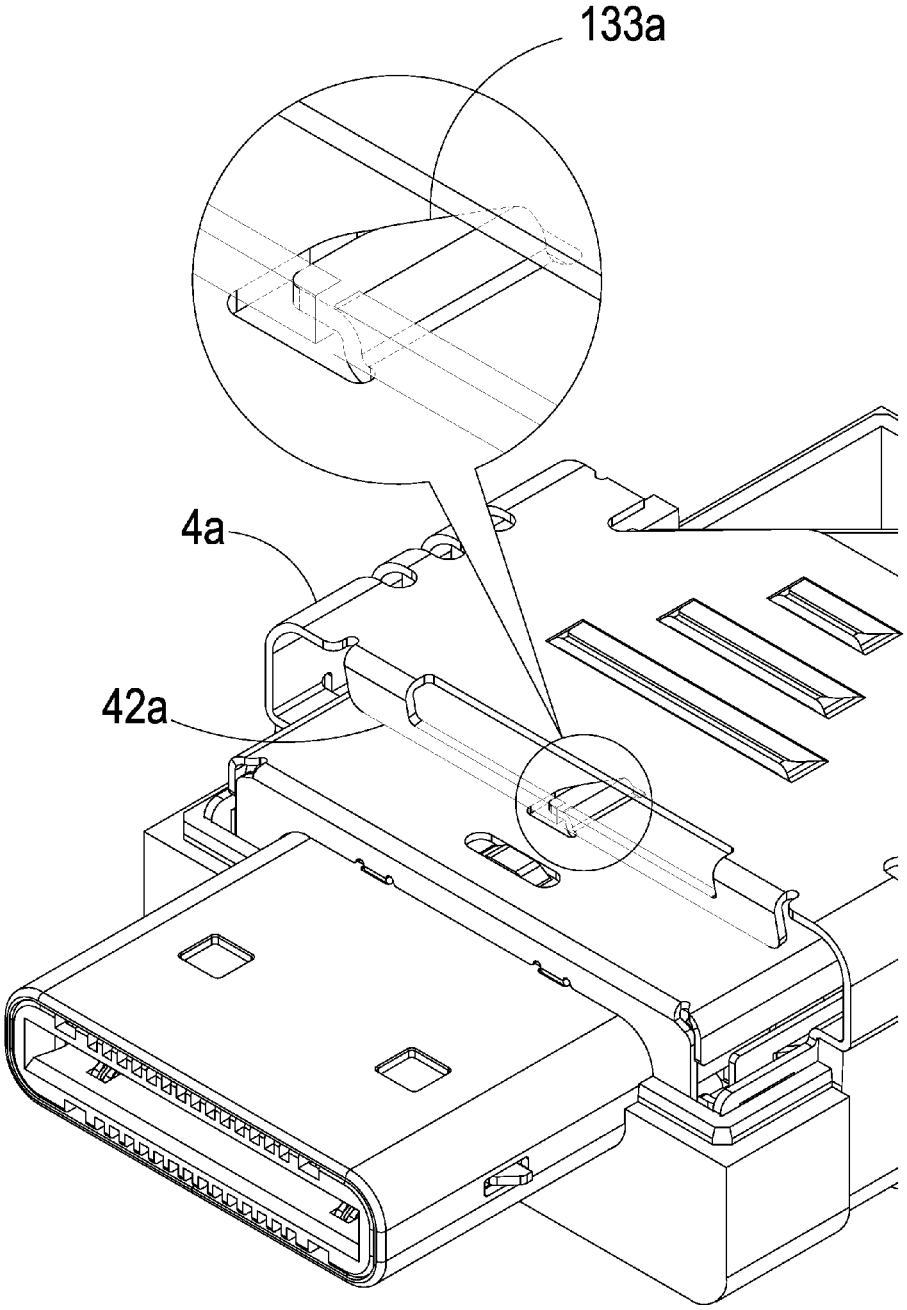
FIG. 5 is a perspective diagram showing a front portion of a connector according to another embodiment of the present invention.

As shown in FIG. 5, in another embodiment of the present invention, the resilient element 42 contains two elongated and aligned pieces 42*a* with a gap in between, and the limiting element 133*a* has an L-like shape. When the sliding member 4*a* is pulled backward, the limiting element 133*a* deforms the flexible pieces 42*a* and the restoration energy is as such produced and stored.

Figure 6:
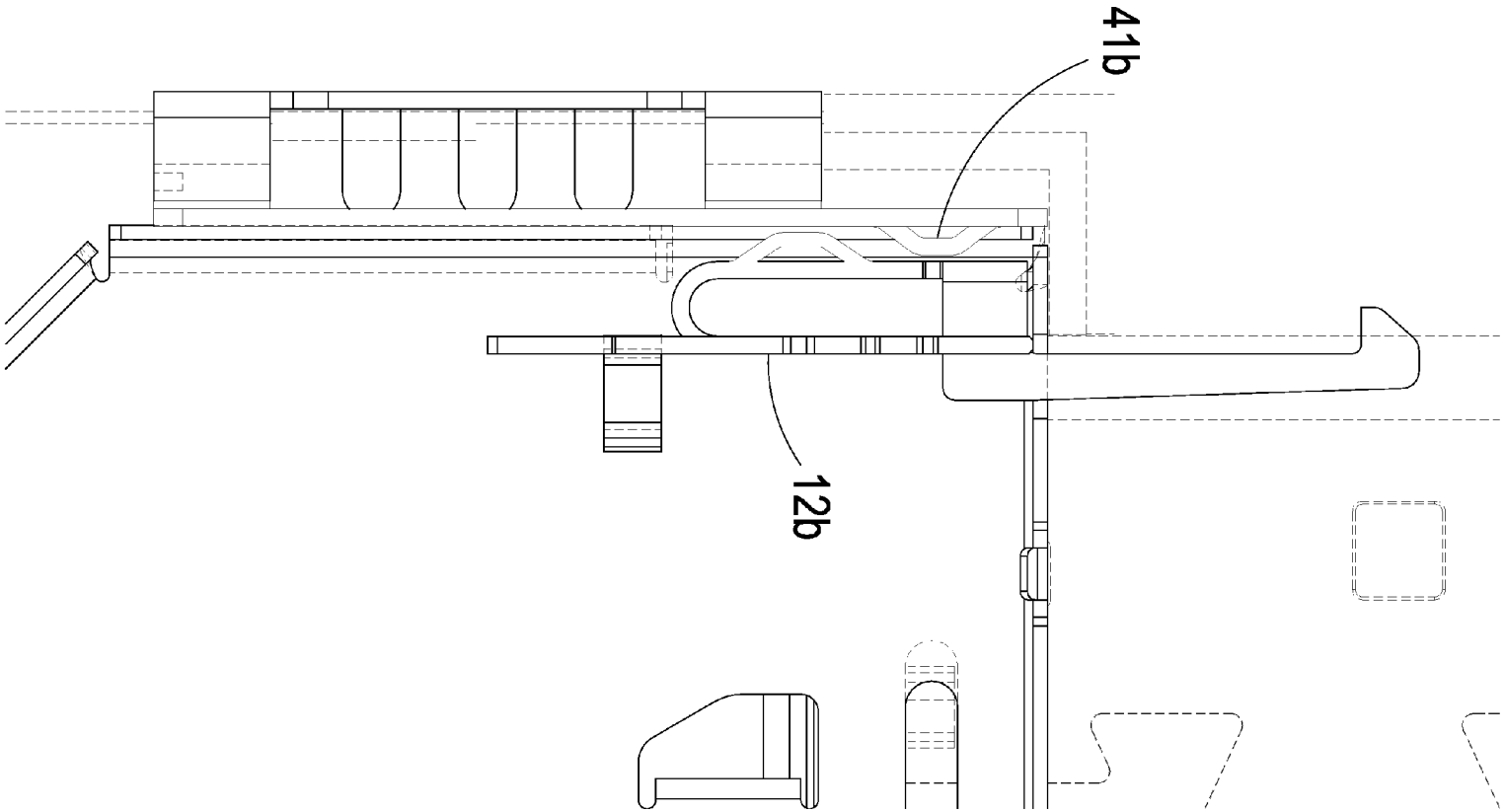
FIG. 6 is a sectional partial diagram showing a connector according to yet another embodiment of the present invention.

As shown in FIG. 6, according to yet another embodiment of the present invention, the locking element 12*b* of the main member 1 is directly engaged by the second bulge element 41*b*. In other words, the first bulge element and the drive element are integrated with the locking element 12*b*. When a number of neighbouring female connectors are all occupied, the present embodiment allows the male connectors of the present invention to be unplugged directly by the second bulge element 4*ab* and the locking element 12*b*. In addition to be configured along the lateral sides of the connectors, the same mechanism can also be configured on the major sides of the connectors.

Compared to the prior art, the present invention achieves the secured and convenient plugging and unplugging through the interaction between the second bulge element 41 of the sliding member 4 and the locking element 12 of the main member 1.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. A connector, comprising:

a main member comprising a terminal assembly where at least a flexible locking element is configured along a lateral side of the terminal assembly;

at least a casing member housing the main member; and a sliding member slidably configured along a circumference of the casing member where a first bulge element is configured along a lateral side's internal wall for engaging the locking element.

2. The connector according to claim 1, wherein the main member further comprises an insulator sleeve for receiving a front portion of the terminal assembly, and a shielding enclosure joining to a back side of the insulator sleeve and enclosing a back portion of the terminal assembly; and the shielding enclosure has at least a second bulge element for engaging the first bulge element and a drive element connected to the second bulge element for pressing the locking element, both along a lateral side of the shielding enclosure.

3. The connector according to claim 2, wherein the shielding enclosure has a limiting element on a major side of the shielding enclosure.

4. The connector according to claim 3, wherein a resilient element is configured along a front edge of the sliding member for engaging the limiting element to restore the sliding member.

5. The connector according to claim 1, wherein at least a handle element is configured on a major side of the sliding member which is one of a through slot, a ditch, and a rib.

6. The connector according to claim 1, wherein the connector is a male connector.

7. The connector according to claim 6, wherein a hook is configured at a front end of the locking element for engaging a corresponding female connector.

8. The connector according to claim 1, wherein the terminal assembly conforms to the specification of Super Mobile High-definition Link (Super MHL).

9. The connector according to claim 1, wherein the sliding member is slidably configured in an indentation around a middle section of the casing member's circumference.

* * * * *